US006360642B1

(12) United States Patent
Miller et al.

(10) Patent No.: US 6,360,642 B1
(45) **Date of Patent: *Mar. 26, 2002**

(54) WORKPIECE GUIDE WITH POSITIONABLE GUIDE SURFACE

(75) Inventors: David Miller, Tupelo; Kim Dewayne Stanford, Saltillo, both of MS (US)

(73) Assignee: Delta International Machinery Corp., Jackson, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,809

(22) Filed: Aug. 19, 1998

(51) Int. Cl.[7] ..... B26D 7/02

(52) U.S. Cl. ..... 83/468.7; 83/438; 83/477.2; 369/303; 369/309; 369/315

(58) Field of Search ..... 83/468.2, 468.4, 83/468.7, 477.2, 438, 829; 269/318, 303–307, 315–320

(56) References Cited

U.S. PATENT DOCUMENTS 4,600,184 A 7/1986 Ashworth
5,181,446 A * 1/1993 Theising ..... 83/438
5,269,356 A * 12/1993 Bartz ..... 144/345
5,293,802 A * 3/1994 Shiotani et al. ..... 83/468.7
5,722,308 A * 3/1998 Ceroll et al. ..... 83/438

OTHER PUBLICATIONS

Instruction Manual for Delta Model No. 34–897 Unifence® fence system and No. 34–998 Table and Shelf accessories, dated Dec. 1, 1992.

Parts listing for Delta Model No. 34–897 Unifence® fence system and No. 34–998 Auxiliary Table and Shelf, revised Jul. 20, 1994.

* cited by examiner

*Primary Examiner*—Lee Young
*Assistant Examiner*—Rick Kiitae Chang
(74) *Attorney, Agent, or Firm*—Kirkpatrick & Lockhart LLP

(57) ABSTRACT

A workpiece guide includes a fence receiving member having first and second sides, a first mounting member disposed adjacent the first side, and a second mounting member disposed adjacent the second side. A first linking member is connected to the first mounting member, and a second linking member is connected to the second mounting member. A link receiving member is connected to both linking members and may be manipulated to selectively simultaneously bias the first and second mounting members toward or away from the link receiving member.

54 Claims, 9 Drawing Sheets

WORKPIECE GUIDE WITH POSITIONABLE GUIDE SURFACE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD AND INDUSTRIAL APPLICABILITY OF THE INVENTION

The present invention relates to workpiece guides and, more particularly, to workpiece guides for cutting devices such as, for example, powered table saws. The present invention may be suitably adapted for use in connection with any device having a saw blade or other cutting member and wherein a workpiece is advanced into the cutting member in a controlled manner. Examples of possible applications of the workpiece guide of the present invention include use as a workpiece rip fence for a powered table saw.

BACKGROUND OF THE INVENTION

Several known cutting devices include a cutting member such as, for example, a saw blade, that is at least partially surrounded by a workpiece support surface. In such devices, a workpiece is advanced along the workpiece support surface and into the driven cutting member to cut the workpiece. A familiar example of such a device is a powered table saw, which includes a rotating circular saw blade that is surrounded by a generally planar workpiece support surface or "saw table" on which the operator slides the workpiece so as to contact the saw blade.

In order to accurately cut the workpiece to the desired dimensions, workpiece guides and other workpiece positioning devices are known. For example, miter gauges, rip fences, and workpiece jigs are available to accurately position a wooden workpiece relative to the saw blade of a table saw. Rip fence workpiece guides have long been used on table saws for providing a fixed guide surface against which the wooden workpiece can be positioned and advanced during ripping operations. Generally, known rip fences have included an elongated fence member having two opposed, parallel faces that extend across the saw table from the front of the saw (i.e., adjacent the typical position of the operator of the saw) to the rear of the saw and generally parallel to the plane of the circular saw blade. The rip fences have themselves been secured either solely to a guide bar attached and extending parallel to the front of the saw table or to a set of guide bars, one guide bar attached to each of the front and the back of the saw table. Commonly, the front guide bar includes a measuring scale so that the operator may ascertain the distance between the rip fence and the saw blade or other cutting member. Ripping of a workpiece may be conducted by advancing the workpiece into the cutting member along the saw table on either side of (i.e., to the left or right of) the cutting member therefore, and the guide bars typically extend along the saw table to either side of the cutting member so that the rip fence may be mounted at positions to the left and right of the cutting member.

An example of a rip fence that is secured solely to the front guide bar of a table saw is that described in U.S. Pat. No. 4,600,184, the entire disclosure of which is hereby incorporated herein by reference. The rip fence of the '184 patent, which is partially shown in attached FIG. 9, includes a fence receiving member 10 and a workpiece fence 14 in the form of an elongated body having a number of workpiece guide surfaces on which a workpiece may by advanced during ripping operations. To accommodate placement of the '184 patent's rip fence to either side of the cutting member, the workpiece fence 14 may be releasably secured to either side of the fence receiving member 10 by a workpiece fence attachment system including knobs 16, fasteners 20, and plate 26. By threadedly advancing knobs 16 onto threaded fasteners 20 disposed through fence receiving member 10, wall 24 of the fence 14 may be securely clamped between the fence receiving member 10 and plate 26. The knobs 16, fasteners 20, and plate 26 are shown in FIG. 9 in positions appropriate for placement of the rip fence of the '184 patent to the right side of the cutting member, as that position is viewed from the typical position of an operator standing in front of the table saw. When ripping stock on the opposite side of the cutting member, the knobs 16 are unthreaded from the fasteners 20, the fasteners 20 are removed from the fence receiving member 10, and the orientation of the fasteners 20 and plate 26 is reversed so that the plate 26 is positioned on the opposite side of the fence receiving member 10. The workpiece fence 14 is then repositioned so that wall 24 is disposed between the plate 26 and the fence receiving member 10, but on the opposite side of the fence receiving member 10. The knobs 16 are then re-threaded securely onto the fasteners 20 so that the wall 24 is secured between the plate 26 and the fence receiving member 10.

Although the rip fence of the '184 patent allows the fence and its workpiece guide surface to be positioned on either side of the cutting member, repositioning the fence from one to another side of the fence receiving member requires unthreading the knobs 16 and reversing the arrangement of the knobs 16, fasteners 20, and plate 26. When a series of workpieces are being ripped on alternate sides of the cutting member, the unthreading and repositioning procedure may need to be repeated a number of times. Therefore, it may be desirable to reduce the time and number of steps that is required to reposition the workpiece fence of the rip fence.

Accordingly, it would be advantageous to provide a table saw rip fence having a positionable workpiece guide surface that may be quickly and easily repositioned to allow ripping on opposite sides of the table saw's cutting member. More generally, and because a rip fence only represents one possible adaptation of a workpiece guide, it would in a broader sense be advantageous to provide a workpiece guide having a positionable workpiece guide surface that may be quickly and easily repositioned. Thus, a need exists for an improved workpiece guide providing such advantages.

SUMMARY OF THE INVENTION

The present invention addresses the forgoing needs, among others, by providing an improved workpiece guide including a fence receiving member having first and second sides. A first mounting member is disposed adjacent the first side, and a second mounting member is disposed adjacent the second side. An attachment system is mounted on the fence receiving member and is connected to both the first and second mounting members, and the attachment system may selectively simultaneously bias the first mounting member toward the fence receiving member's first side and the second mounting member toward the fence receiving member's second side.

In one embodiment, the attachment system includes a plurality of linking members and at least one link receiving member. A first linking member is connected to the first mounting member, a second linking member is connected to the second mounting member, and both the first and the second linking members are connected to the link receiving member. The link receiving member may be manipulated to selectively simultaneously bias the first and second mounting members toward the link receiving member. Preferably, rotation of the link receiving member selectively simultaneously biases the first and second mounting members toward the link receiving member.

The workpiece guide of the present invention also may include a fence having a workpiece guide surface and an attachment portion. The attachment portion may be positioned intermediate the first mounting member and the first side of the fence receiving member or, in the alternative, intermediate the second mounting member and the second side. The link receiving member is manipulated, and preferably is rotated, to selectively secure the attachment portion of the fence in the selected intermediate position. In that way, the fence may be secured against one of the first side and the second side of the fence receiving member.

The present invention also is directed to a workpiece guide including a fence receiving member having first and second sides, a first mounting member disposed adjacent the first side, and a second mounting member disposed adjacent the second side. First and second linking members are connected to the first and second mounting members, respectively, and a first link receiving member is connected to both the first and second linking members and may selectively simultaneously bias the first and second mounting members toward or away from the first link receiving member. In one form, the first and second linking members each include a threaded region and the first link receiving member threadedly receives at least a portion of the threaded region of each of the first and second linking members. By that arrangement, rotation of the link receiving member in a particular direction may cause the first and second linking members to either simultaneously threadedly advance into or simultaneously threadedly withdraw at least some extent from the first link receiving member, thereby varying a distance between the first and second mounting members. Preferably, the threaded region of one of the first and second linking members includes right hand threads and the threaded region of the other of the first and second linking members includes left hand threads to thereby provide for the simultaneous advancement or withdrawal.

The workpiece guide of the invention may further include at least third and fourth linking members, each including a threaded region. The third and fourth linking members are connected to the first and second mounting members, respectively, and also are threadedly connected to a second link receiving member. Movement, and preferably rotation, of the second link receiving member in a particular direction causes the third and fourth linking members to either simultaneously threadedly advance into or simultaneously threadedly withdraw at least some extent from the second link receiving member, to thereby vary a distance between the first and second mounting members. Any number of additional linking members and link receiving members also may be provided. For example, the workpiece guide may include a total of eight linking members, four connected to each mounting member, and with four link receiving members, each attached to two link members.

The first and second mounting members may be, for example, bars or plates, and each linking member may be, for example, a bolt or stud having a first end (which may include the threaded region) and a second end connected to one of the mounting members. In such form, it is preferred that each stud is disposed through the side of the fence receiving member adjacent the plate to which the particular stud or bolt is attached.

The first link receiving member and the second link receiving member may be connected by a transmission or a linkage, and rotation of the first link receiving member is transmitted through the transmission or linkage to cause rotation of the second link receiving member in the same direction of rotation. A lever may be attached to one of the link receiving members to facilitate rotation of the link receiving member by an operator. The fence receiving member preferably defines a cavity in which the first and second link receiving members are disposed. Any additional link receiving members may be similarly connected by a transmission or linkage and/or disposed in the cavity.

In one form, the workpiece guide of the present invention is adapted for use as a rip fence that may be selectively attached to a guide bar of a table saw. As further described in the following detailed description of embodiments of the invention, the construction of the present workpiece guide allows the fence to be repositioned on the fence receiving member without the removal of knobs or fasteners as in the prior art '184 patent. It therefore may provide the advantage of reducing the number of steps involved in detaching and reattaching the fence, thereby quickening the fence repositioning process. Thus, when the present invention is adapted for use as a table saw rip fence, the workpiece fence, which includes a workpiece guide surface, may be easily and conveniently repositioned to allow for ripping operations on either side of the saw blade.

The reader will appreciate the foregoing details and advantages of the present invention, as well as others, upon consideration of the following detailed description of embodiments of the invention. The reader also may comprehend such additional details and advantages of the present invention upon using the invention.

BRIEF DESCRIPTION OF THE DRAWINGS

The features and advantages of the present invention may be better understood by reference to the accompanying drawings in which like reference numerals refer to like elements and in which.

DESCRIPTION OF EMBODIMENTS OF THE INVENTION

While the present invention is susceptible of embodiment in many different forms, this specification and the accompanying drawings disclose only specific forms as examples of the invention. The invention, however, is not limited to the embodiments so described, and the scope of the invention is better described in the appended claims. In addition, the workpiece guide of the invention may be used with certain conventional devices such as, for example, table saws or other cutting devices including a workpiece support surface, and the details of those conventional devices, although not fully described or illustrated herein, will be apparent to those having ordinary skill in the art.

For ease of description, the invention and devices to which it may be attached may be described herein in a normal operating position, and terms such as upper, lower, front, back, horizontal, proximal, distal, etc., may be used with reference to the normal operating position of the referenced device or element and/or the normal position of an operator using the invention on a device to which it may be mounted. It will be understood, however, that the apparatus of the invention may be manufactured, stored, transported, used, and sold in orientations other than the positions described.

Figure 1:
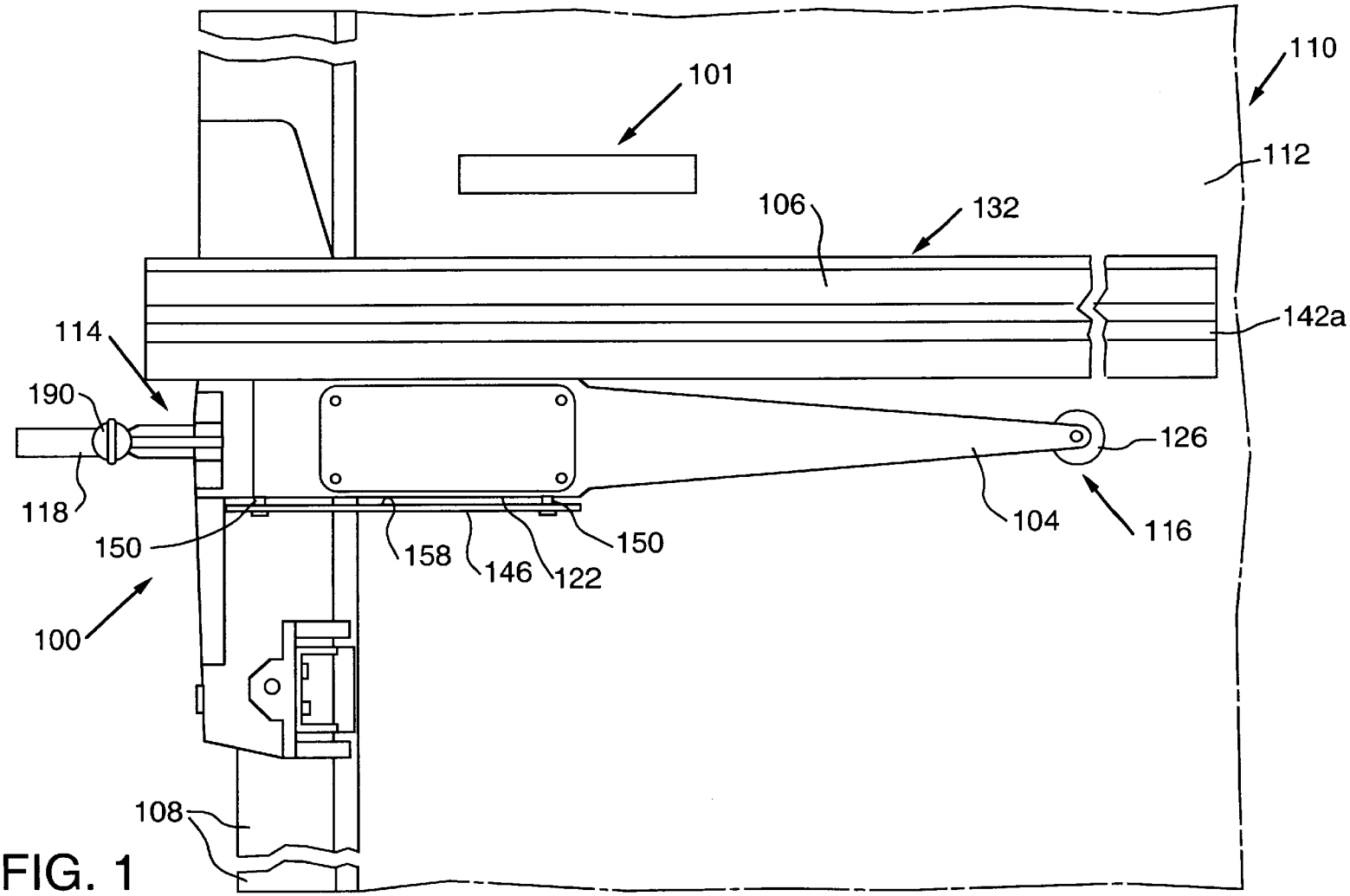
FIG. 1 is a top view of an embodiment of a workpiece guide constructed according to the present invention with the workpiece fence of the workpiece guide attached to a first side of the fence receiving member and with the workpiece guide mounted on a table saw guide bar and extending across a portion of the table saw's saw table.
Figure 2:
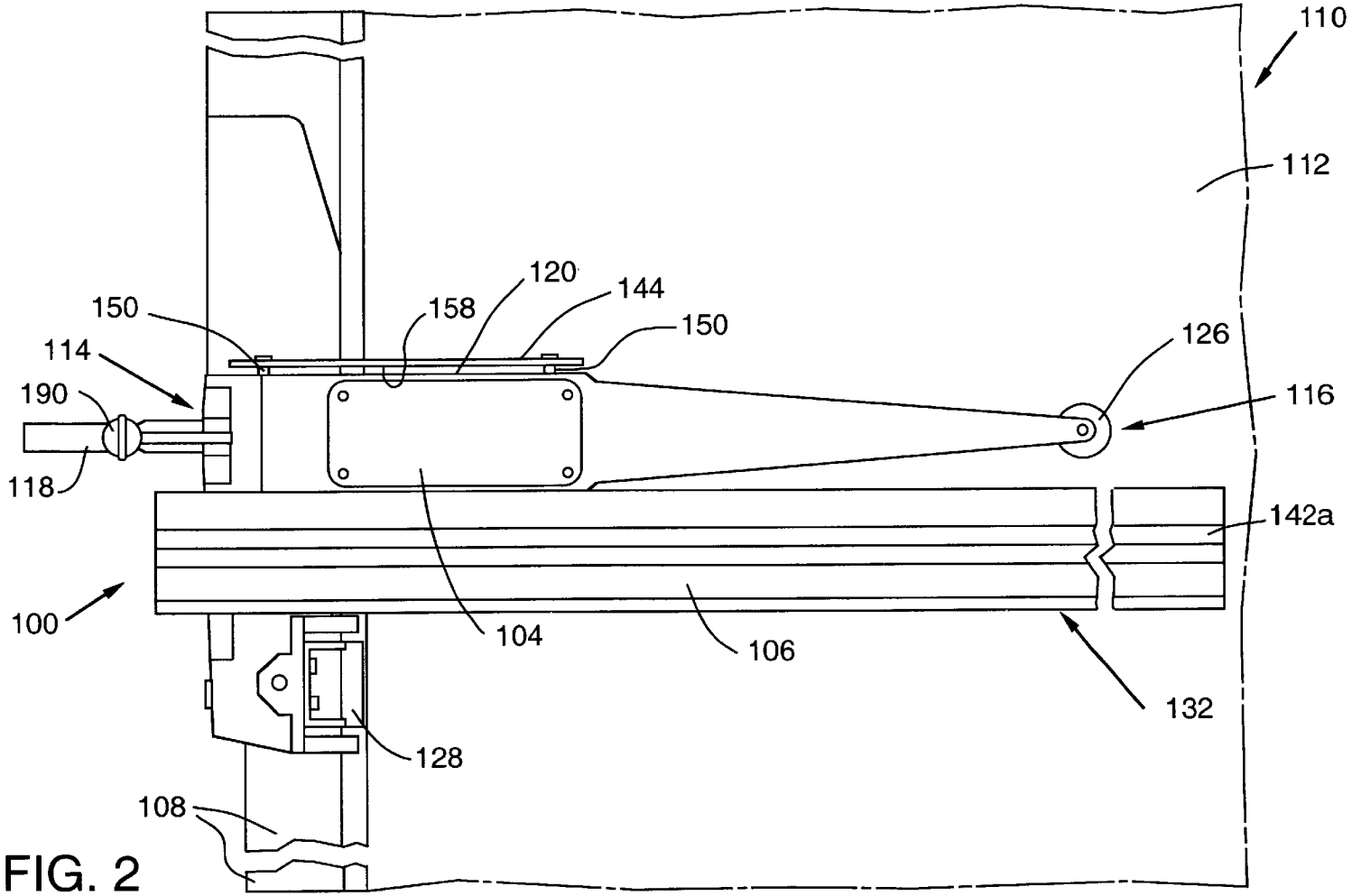
FIG. 2 is a top view of the workpiece guide embodiment shown in FIG. 1, extending across a portion of the saw table and with the workpiece fence of the workpiece guide attached to a second, opposite side of the fence receiving member.

Referring now to the drawings, which are for the purpose of illustrating embodiments of the workpiece guide of the present invention and not for the purpose of limiting the same, a workpiece guide generally designated as 100 is provided in the form of a rip fence for guiding workpieces on the workpiece support surface of a table saw during, for example, ripping operations. As particularly shown in FIGS. 1 and 2, the workpiece guide 100 includes a fence receiving member 104 and a workpiece fence 106. FIGS. 1 and 2 depict the workpiece guide 100 attached to a guide bar 108 of a table saw generally indicated as 110. The method of attachment of the fence receiving member 104 to the guide bar 108 is that generally disclosed in incorporated U.S. Pat. No. 4,600,184 and, therefore, the method of attachment and the associated attachment elements are not described herein. As is conventional, and as is also shown in the '184 patent, the fence receiving member 104 and the workpiece fence 106 extend partially across the table saw's workpiece support surface 112. The general position of the workpiece support surface 112 is indicated by the broken lines in FIGS. 1 and 2. Segments of the guide bar 108 and a segment of the workpiece fence 106 have been excluded from FIGS. 1 and 2 so as to allow for greater detail in the remaining depicted elements.

The fence receiving member 104 includes a proximal end 114 that is adjacent the typical position of an operator of the table saw, and also includes an opposite, distal end 116. The fence receiving member 104 also includes a lever 118 for selectively securing the fence receiving member 104 to the guide bar 108 at a selected location. The fence receiving member 104 is generally elongate and, in the vicinity of the proximal end 114, includes opposed, generally parallel first and second sides 120 and 122. As viewed from above as shown in FIGS. 1 and 2, the region of the fence receiving member 104 in the vicinity of the distal end 116 is tapered and generally triangular in shape and includes a foot member 126 for partially supporting the fence receiving member 104 on the workpiece support surface 112. The fence receiving member 104 further includes an indicator 128 that may be used to index measurement lines (not shown) on the guide bar 108 in order to locate the workpiece guide 100 at a desired position relative to the saw blade 101 of the table saw 110.

Figure 6:
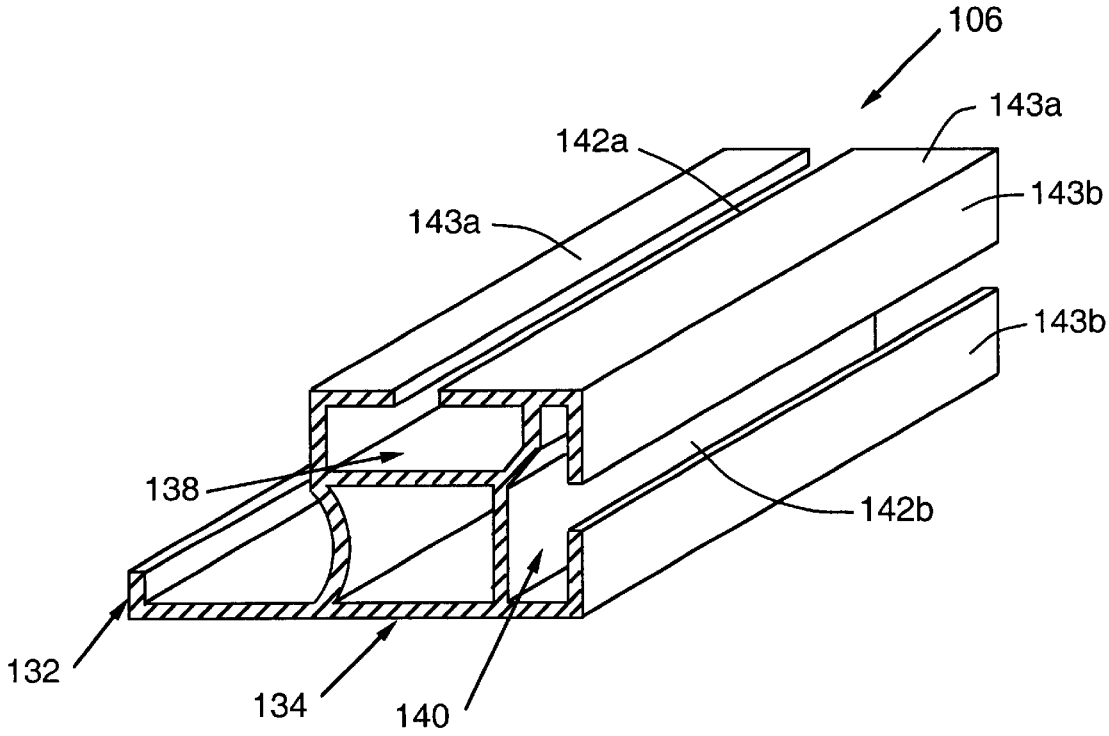
FIG. 6 is an isometric, cross-sectional view of the workpiece fence included in the embodiment of the workpiece guide shown in FIGS. 1 and 2.

As indicated in FIGS. 1 and 2, the workpiece fence 106 may be secured to the fence receiving member 104 in two positions so as to either abut the fence receiving member's first side 120 or second side 122. The workpiece fence 106 includes one or more workpiece guide surfaces which a workpiece may contact and be advanced upon to contact the saw blade during ripping operations. A preferred form of the workpiece fence 106 is depicted in an isometric, cross-sectional view in FIG. 6 and includes alternative workpiece support surfaces 132 and 134. As further described below, depending on the orientation of attachment of the workpiece fence 106 to the fence receiving member 104 one or the other of the workpiece support surfaces 132 and 134 will be suitably oriented relative to the workpiece support surface 112 so as to be capable of being slidingly contacted by a workpiece. The workpiece fence 106 may be provided in the form of, for example, an aluminum extrusion and includes continuous first and second channels 138 and 140 running its entire length. One of the walls defining each channel 138 and 140 includes an open, continuous slot 142*a* and 142*b*, respectively, running the entire length of the workpiece fence 106. The two generally coplanar walls 143*a* bordering slot 142*a* define an attachment portion described in greater detail below. Similarly, the two coplanar walls 143*b* bordering slot 142*b* define such an attachment portion. As further treated below, each slot 142*a* and 142*b* is configured to slidingly accept elements of the workpiece guide 100 so as to secure the workpiece fence 106 to the fence receiving member 104 in a desired location and orientation. It will be understood that workpiece fences of other configurations may be incorporated as elements of the present invention. Any such workpiece fence need only include at least one suitable workpiece guide surface and a portion or region that may be secured against either of the first and second sides of the fence receiving member of the present invention as is generally described herein.

A first mounting member 144 is disposed adjacent the first side 120 of the fence receiving member 104, and a second mounting member 146 is disposed adjacent the second side 122 of the fence receiving member 104 as used herein, the term "adjacent" means that the particular mounting member is next to or lies near, but does not necessarily contact the fence receiving member, and, as will be evident below, some portion of the workpiece fence 106 may be disposed intermediate mounting member and the fence receiving member. As indicated in FIGS. 1 and 2 and shown in FIG. 5, the first and second mounting members 144 and 146, respectively, preferably are each in the form of a generally flat, rectangular-shaped plate that may be constructed of, for example, a durable metallic material. As best shown in FIG.

Figure 5:
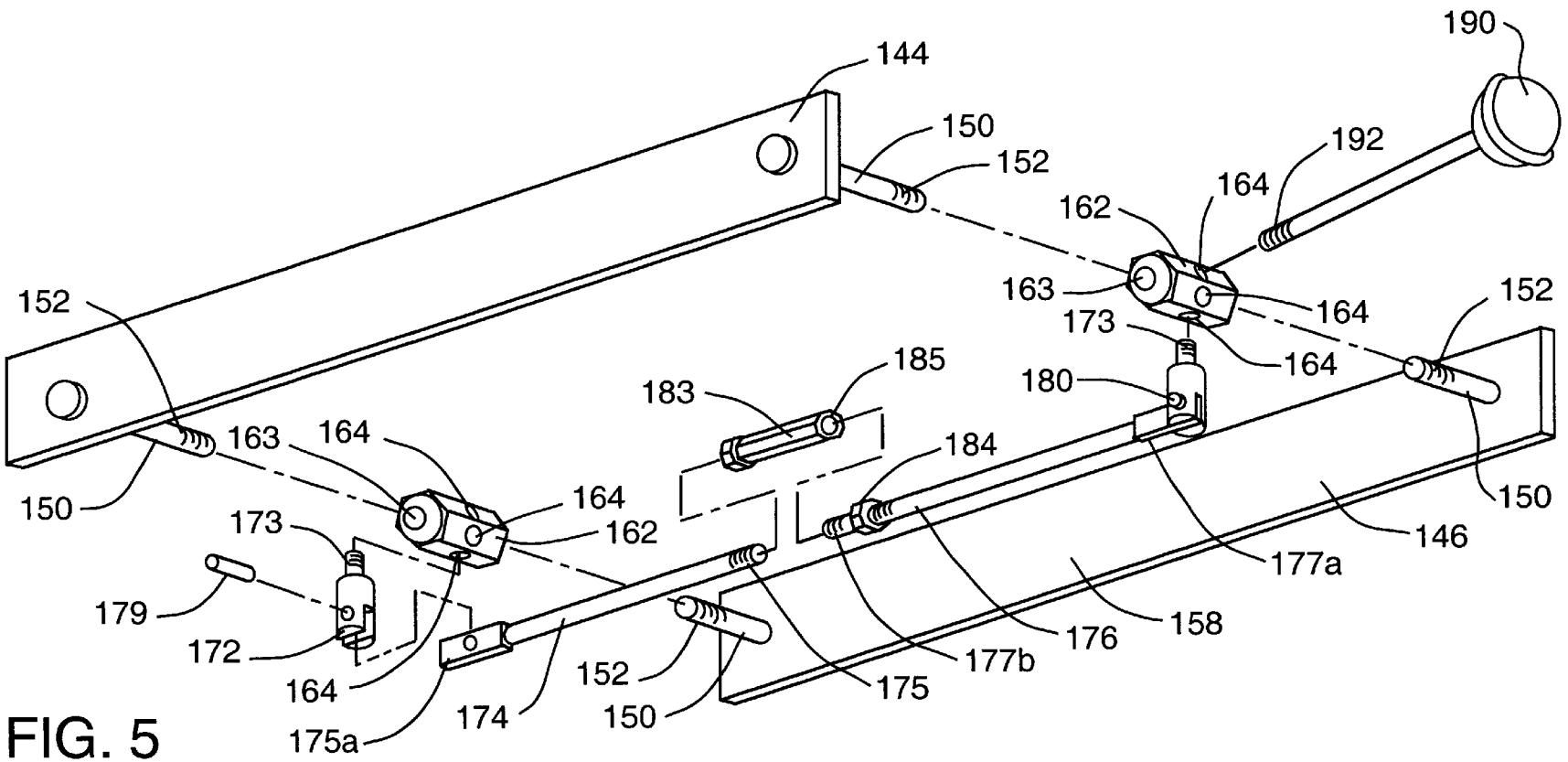
FIG. 5 is an assembly view showing the identities and indicating the arrangement of various elements of the embodiment of the workpiece guide of the present invention shown in FIGS. 1–4.

5, two linking members that preferably are in the form of studs 150 are fixedly connected at a first end to each mounting member 144 and 146. Each stud 150 is connected to its respective mounting member 144, 146 so that the stud 150 may not rotate relative to the mounting member. A second end of each stud 150 includes a threaded region 152. Each of the studs 150 connected to the first mounting member 144 is disposed through the first side 120. Each of the studs 150 connected to the second mounting member 146 is disposed through the second side 122. In that way, the threaded region 152 of each stud 150 is disposed in a cavity 154 (indicated in FIGS. 8 and 9) within the fence receiving member 104 that is partially bounded by the first and second walls 120 and 122. The sides 120, 122 of the fence receiving member 104 and the mounting members 144, 146 preferably are configured so that at an inner surface 158 of each mounting member 144, 146 may closely conform to its corresponding adjacent side 120, 122. The inner surface 158 of the second mounting member 146 is shown in FIG. 5.

Each mounting member 144, 146 is dimensioned so that it may be received in either of the first and second channels 138 and 140 of the workpiece fence 106, and the slots 142*a* and 142*b* of the workpiece fence 106 are dimensioned so that when either of mounting member 144 or 146 is disposed within a channel 138 or 140, the studs 150 attached to the particular mounting member may extend through the slot 142*a* or 142*b* while preventing passage of the mounting member therethrough. Thus, it will be understood that when, for example, the first mounting member 144 is disposed in the second channel 140, the walls 143*b* forming an attachment portion of the workpiece fence 106 will be at least partially disposed between the inner surface 158 of the mounting member 144 and the first side 120 of the fence receiving member 104. Similarly, it will be understood that when the second mounting member 146 is disposed within the second channel 140, the walls 143*b* will be at least partially disposed between the inner surface 158 of the second mounting portion 146 and the second side 122 of the fence receiving member 104. Thus, by drawing the mounting portions 144, 146 sufficiently inward toward the fence receiving member 104, any portion of the walls 143*b* that is disposed intermediate the fence receiving member 104 and the mounting portion 144 or 146 will be clamped to the fence receiving member 104. In that way, the workpiece fence 106 may be secured in place on the desired first or second side 120, 122 of the fence receiving member 104. Accordingly, by sliding one of the first or second mounting member 144, 146 into a selected first or second channel 138, 140 and clamping at least a region of the attachment portion of the selected channel 138, 140 against the fence receiving member 104, both a position of the workpiece fence 106 on the fence receiving member 104 and a particular workpiece guide surface 132, 134 of the workpiece fence 106 may be selected.

FIGS. 1 and 2 depict the workpiece fence 106 in each of the two positions on the fence receiving member 104 that may be selected in the present embodiment of the invention. FIG. 1 depicts the workpiece fence 106 in a position suitable for ripping stock with the workpiece guide 100 positioned to the right side of the saw blade of the table saw 110. FIG. 2 depicts workpiece fence 106 in a position suitable for ripping stock with the workpiece guide 100 positioned to the left side of the saw blade. Although each of FIGS. 1 and 2 shows the workpiece guide surface 132 in a position to contact a workpiece (and, thus, the mounting member must be disposed in the second channel 140), the workpiece fence may alternately be oriented so that the workpiece guide surface 134 is in the operating position (in which case the mounting member is disposed within first channel 138).

The arrangement of elements of the workpiece guide 100 for clamping or otherwise securing the attachment portion of a selected channel 138, 140 to the fence receiving member in either of the positions of FIGS. 1 and 2 will now be described. As indicated in FIG. 5, at least a portion of the threaded region 152 of each stud 150 is threadedly received in a link receiving member that is provided in the form of a barrel-shaped nut 162 having a hexagonal perimeter. Two such nuts 162 are provided, and each nut 162 includes a threaded bore 163 disposed generally through its central axis. As best indicated in FIG. 5, the threaded bore 163 of each nut 162 threadedly receives at least a portion of the threaded region 152 of one stud 150 connected to the first mounting member 144 and at least a portion of the threaded region of one stud 150 connected to the second mounting member 146. The threaded regions 152 of the studs 150 that are received by a particular nut 162 include threads oriented in opposite directions. Thus, the threaded region 152 of one of the studs 150 received by a particular nut 162 will have right hand threads, while the threaded region 152 of the remaining stud 150 received by the nut 162 will have left hand threads. It will therefore be understood that as a nut 162 is rotated relative to the two studs 150 to which it is threadedly attached, the threaded regions 152 of the two studs 150 will be either simultaneously drawn further into engagement with the nut 162 or will be simultaneously withdrawn to some extent out of engagement with the first nut 162. A consequence of such simultaneous engagement or withdrawal is that by rotating a nut 162 in a particular direction (i.e., either clockwise or counterclockwise), the mounting members 144, 146 attached to the studs 150 engaged by that nut 162 will be simultaneously biased either toward or away from the nut 162.

Although the embodiment 100 of the present invention described herein utilizes threaded engagement of the linking members (studs 150) and the link receiving members (nuts 162) to provide for simultaneous movement of the mounting members toward or away from the link receiving member upon manipulation of the link receiving member, any suitable alternate arrangement may be used that allows for variation in the distance between the mounting members (or, in the alternative, variation in the effective length of the assemblage of linking members and link receiving member) by manipulation of the link receiving member. It is understood that all such alternate arrangements are encompassed by the present invention. It also will be understood that the linking members and the link receiving member may be considered to constitute elements of an "attachment system" for moving the mounting members and thereby securing a fence or other element to the fence receiving member.

The directions of threads on each of the threaded regions 152 of each of the studs 150 is configured so that rotation of each of the two nuts 162 in the same direction of rotation will similarly bias the mounting members either inward or outward relative to the nuts 162. A transmission or linkage preferably is provided to transmit the rotation of one of the nuts 162 to the other nut 162 so as to rotate such other nut 162 in an identical direction of rotation. In the present embodiment, the transmission or linkage includes a first post 170 and a second post 172. One of the posts 170, 172 is fixedly connected to each nut 162 as indicated in FIG. 5 and extends outward from the nut 162 in a direction generally perpendicular to the axis of the nut's threaded bore 163. Preferably, each post 170, 172 includes a threaded region 173 that may be threadedly received by a threaded bore, such as one of bores 164, on the perimeter of each nut 162. The posts 170 and 172 are connected by a connecting member, which in the workpiece guide 100 includes first and second rods 174 and 176, respectively, and a fastener. The first rod 174 has a first end 175*a* and a threaded second end 175*b*, and the second rod 176 has a first end 177*a* and a threaded second end 177*b*. First end 175*a* is rotatably connected to post 172 by pin 179, and second end 177*a* is rotatably connected to post 170 by pin 180. The threaded ends 175*b* and 177*b* of each rod 174 and 176, respectively, are threadedly received by the fastener, which may be in the form of a nut 183 having a threaded bore 185 throughout its longitudinal length. By providing the threaded ends 175*b* and 177*b* of the rods 174 and 176, respectively, with threads in appropriate directions, rotation of the nut 183 will cause the rods 174, 176 to be either simultaneously drawn further into threaded engagement with the nut 183 or simultaneously withdrawn to some extent out of threaded engagement with the nut 183. Thus, by appropriately rotating the nut 183, the length of the connecting member may be varied and the proper orientation of the nuts 162 may be adjusted. Once the proper extent of threaded engagement between rods 174, 176 and nut 183 is selected, retainer nut 184 may be tightened against nut 183 to secure the latter nut in position.

It will be apparent to one of ordinary skill upon reading this disclosure that transmissions or linkages having alternate configurations may be incorporated into the present invention, and all such configurations suitable to convey rotational motion or other movement of one nut 162 to another nut 162 form a part of the present invention. Thus, for example, a linkage including a one-piece connecting member may be used. Moreover, a transmission or a linkage is not a necessary component of the present invention and, for example, each nut 162 may be adapted so as to be separately rotated to bias regions of the mounting members 144, 146 toward or away from a particular nut 162.

The workpiece guide 100 also may include a lever 190 having an end 192 that is threadedly engaged in one of the threaded bores of a nut 162 (as indicated in FIG. 5) or is otherwise attached to a nut 162. Thus, as will be described in additional detail below, an operator may manipulate the lever 190 to rotate a first nut 162 to which it is connected. Rotation of that first nut 162 is transmitted through the first and second rods 174, 176 to thereby cause the second nut 162 to rotate in a like direction of rotation. By appropriately moving the lever 190, the operator may selectively reduce or increase the distance separating the first and second mounting members 144, 146 to thereby clamp an attachment portion of the workpiece fence 106 disposed intermediate a particular mounting member and a particular side of the fence receiving member 104 to the fence receiving member 104.

Figure 3:
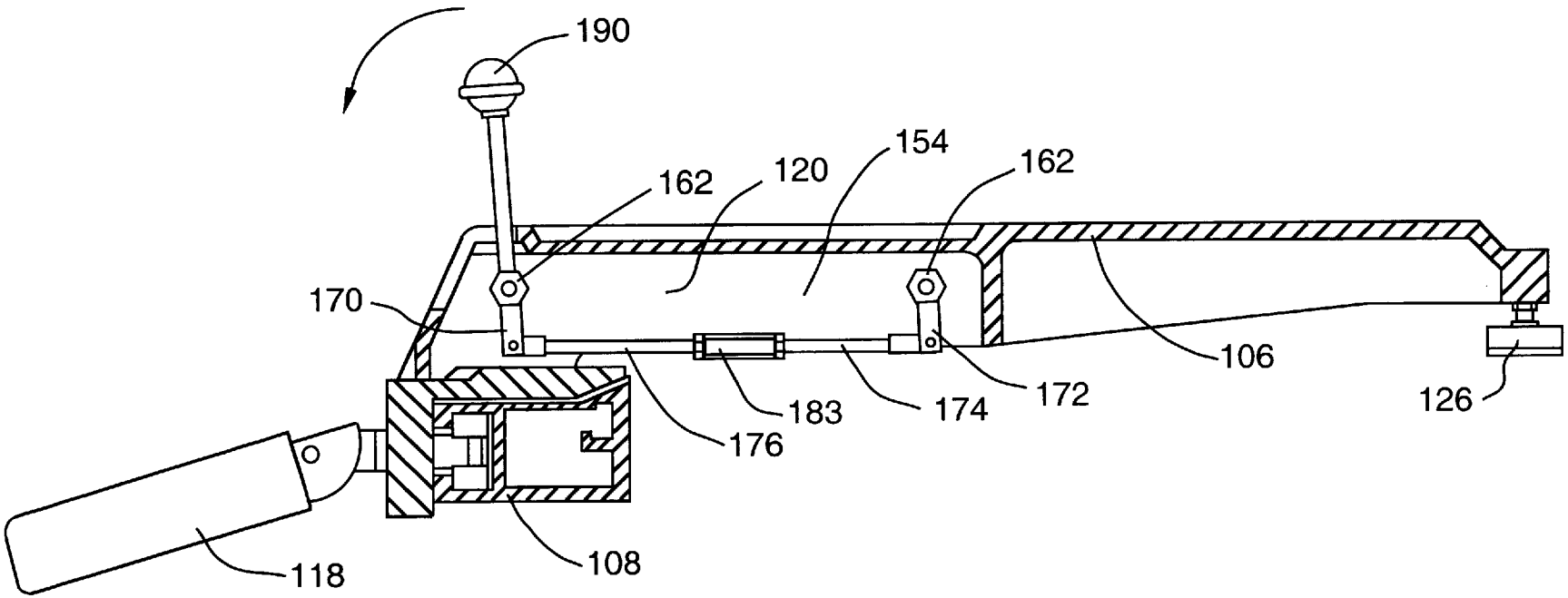
FIG. 3 is cross-sectional view taken through the workpiece guide embodiment and table saw guide bar shown in FIG. 1, and showing the workpiece guide in a first, unsecured configuration.

FIG. 3 is a cross-section through the fence receiving member 104 and through the studs 150 connected to the mounting member 146, and that figure also exposes the interior of the fence receiving member cavity 154. FIG. 3 depicts the workpiece guide 100 in an "unsecured" configuration in which the mounting members 144, 146 are not drawn inward toward the nuts 162 and the fence receiving member 104. In that configuration the workpiece fence 106 may be slid onto or off of one or the other of the mounting members 144, 146. By manipulating lever 190 to rotate the nut 162 to which it is attached in the direction of the arrow in FIG. 3, each of the nuts 162 is rotated in a counterclockwise direction as viewed in FIG. 3, and the elements may thereby be placed in the "secured" configuration, shown in FIG. 4. In the secured configuration of FIG. 4 the extent of threaded engagement between the threaded regions 152 of the studs 150 and the nuts 162 is increased relative to the configuration of elements in FIG. 3, the mounting members 144, 146 are drawn inward toward the nuts 162 and the fence receiving member 104, and any attachment portion of the workpiece guide 106 that is disposed intermediate a mounting member and a first or second side of the fence receiving member 104 is securely clamped between those elements so as to securely attach the workpiece fence 106 to the fence receiving member 104. Movement of the lever 190 in the direction of the arrow in FIG. 4 will reposition the elements in the unsecured configuration of FIG. 3 and allow the workpiece fence 106 to be slid off of the mounting member with which it is associated.

Figure 4:
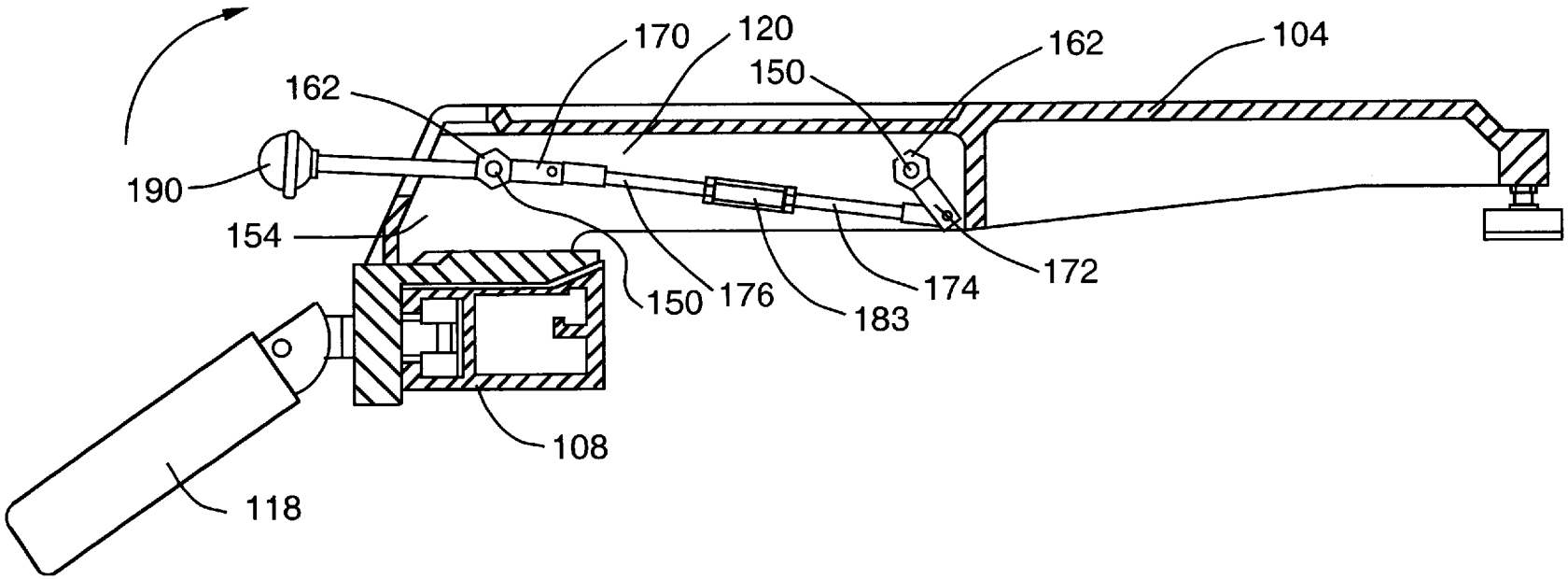
FIG. 4 is a cross-sectional view taken through the workpiece guide embodiment and table saw guide bar shown in FIG. 1, and showing the workpiece guide in a second, secured configuration.
Figure 7:
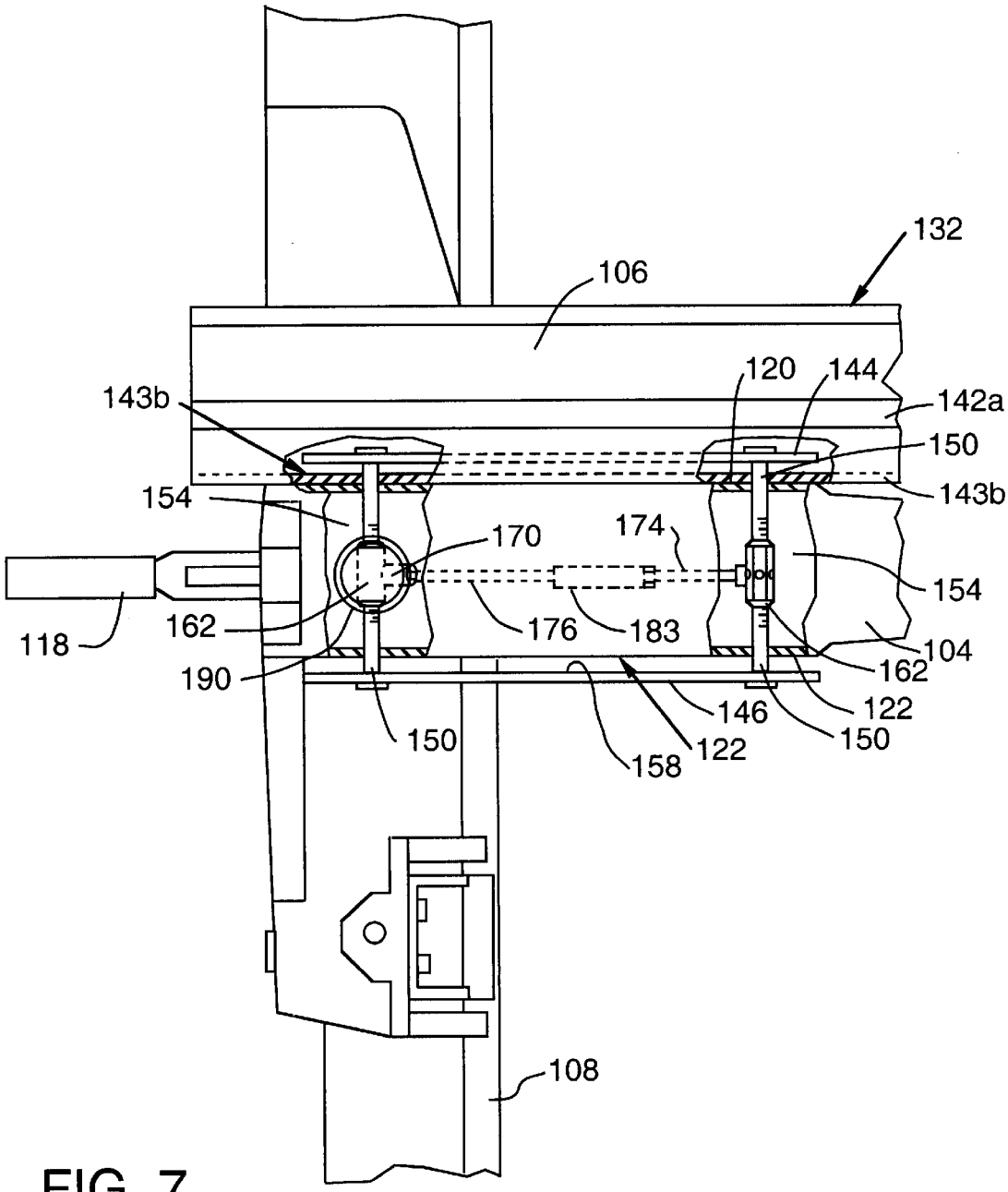
FIG. 7 is a top, partially fragmented view of a portion of the workpiece guide embodiment of FIGS. 1 and 2, showing the workpiece fence in place and showing the workpiece guide in the unsecured configuration.
Figure 8:
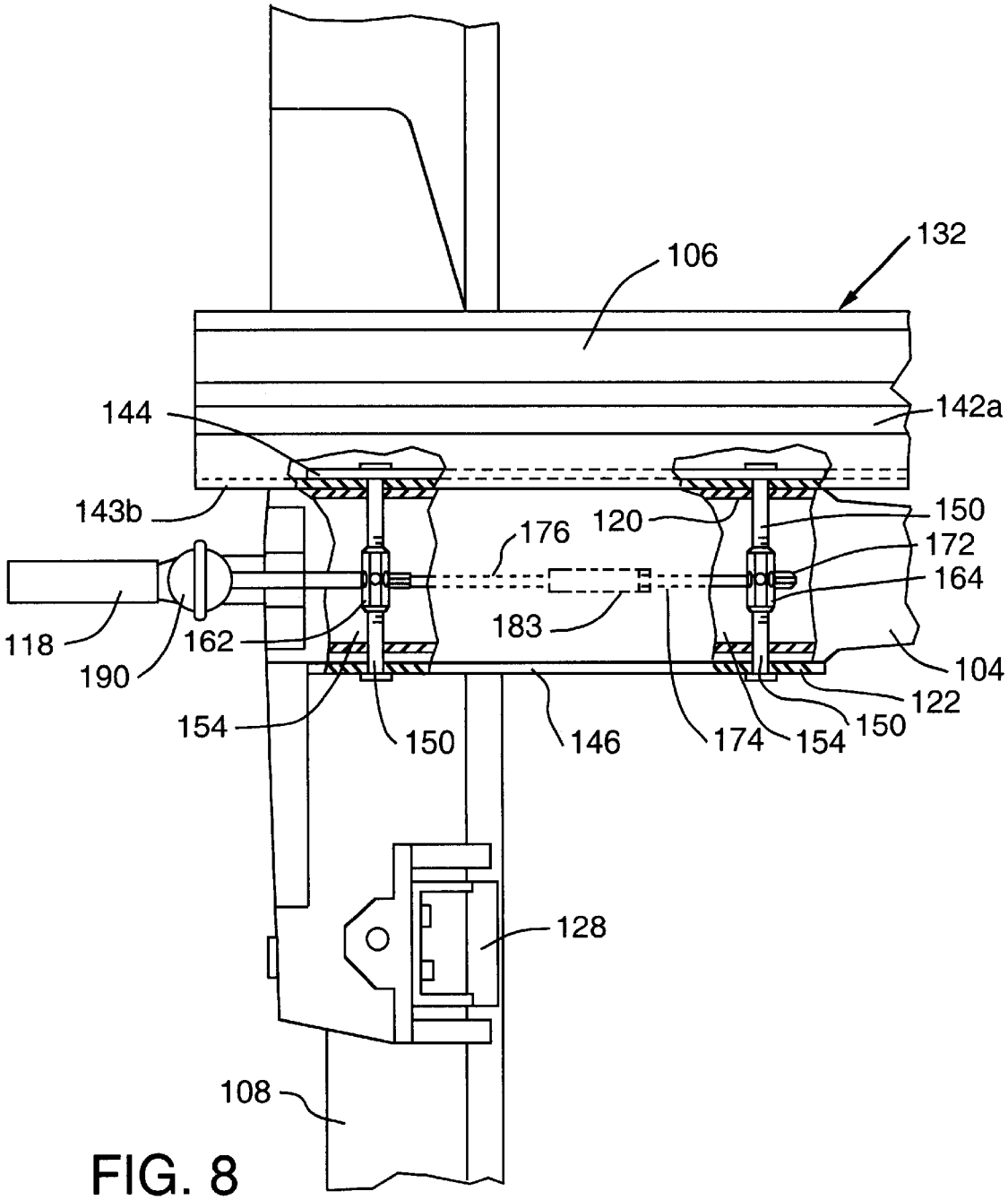
FIG. 8 is a top, partially fragmented view of a portion of the workpiece guide embodiment of FIGS. 1 and 2, showing the workpiece fence in place and showing the workpiece guide in the secured configuration.
Figure 9:
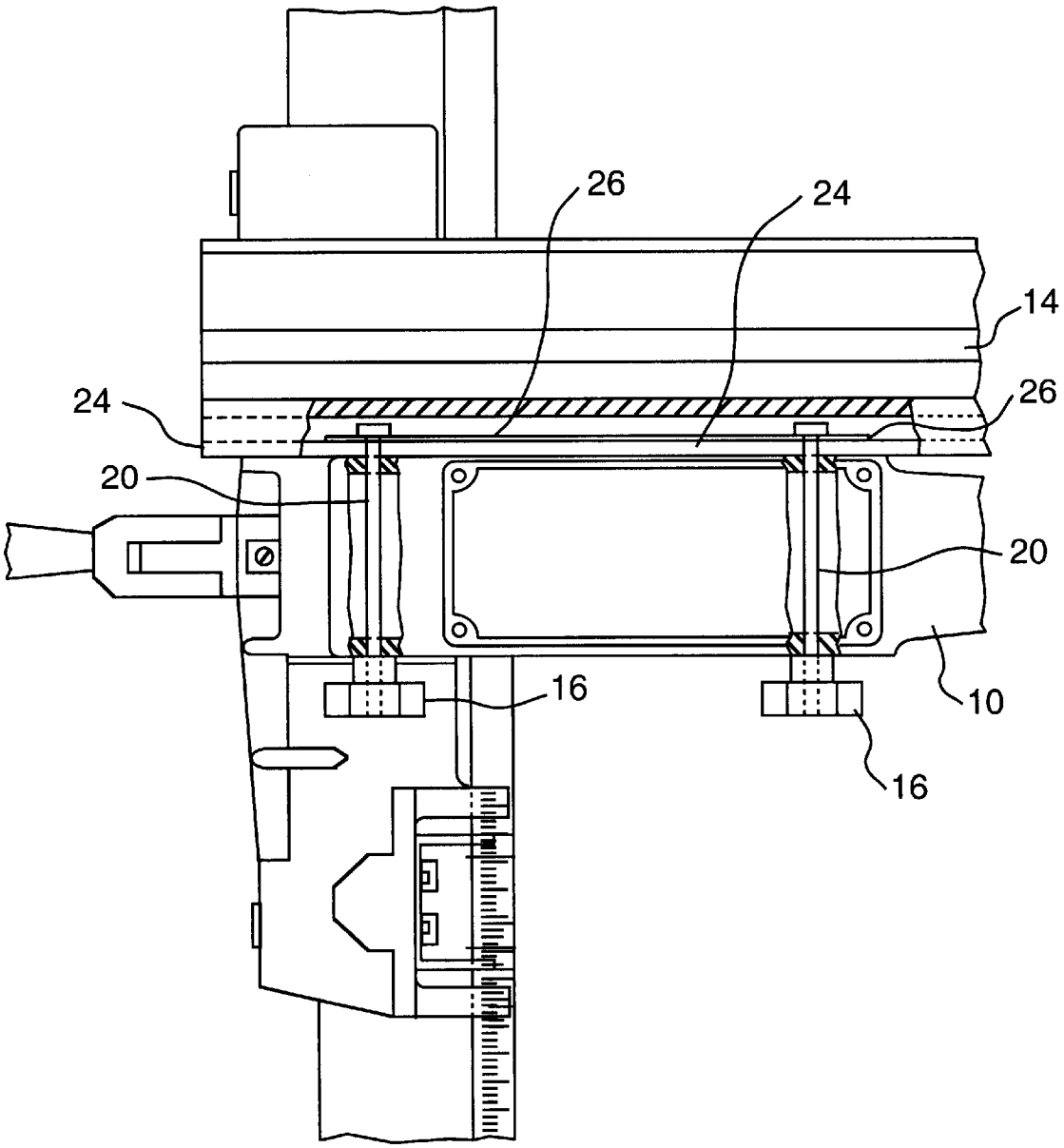
FIG. 9 Prior Art
FIG. 9 is a prior art table saw workpiece guide including a workpiece fence that may be selectively positioned on opposite sides of the workpiece guide's fence receiving member.

An alternative depiction of the secured and unsecured configurations of elements shown in FIGS. 3 and 4 is provided in FIGS. 7 and 8. Each of FIGS. 7 and 8 shows portions of the fence receiving member 104 removed to reveal two regions of the cavity 154 including the nuts 162 therein. Each of FIGS. 7 and 8 also shows a surface of the workpiece fence 106 removed to reveal the interior of second channel 140 and the mounting member 144 disposed therein. FIG. 7 depicts the elements in the unsecured configuration with the lever 190 directly overhead the nut 162 to which it is secured (the nut 162 and post 170 are shown in dashed lines through the spherical end of the lever 190). A gap is shown in FIG. 7 between the mounting members 144 and 146 and the first and second sides 120 and 122, respectively, of the fence receiving member 104. As such, the wall 143*b* of the workpiece fence 106 is not clamped to the fence receiving member 104, and the workpiece fence 106 may be, for example, slid out of engagement with the mounting member 144 and repositioned on mounting member 146. On rotation of the lever 190 downward (i.e., toward the operator and such as indicated by the arrow in FIG. 3), the elements may be disposed in the secured configuration, which is depicted in FIG. 8. By movement of lever 190 from the unsecured configuration to the secured configuration, both nuts 162 have been rotated in a like direction of rotation, the distance separating the mounting members 144, 146 has been reduced by increasing the threaded engagement between the studs 150 and the nuts 162, and the wall 143*b* of the workpiece fence 106 is securely clamped between the mounting member 144 and the first side 120 of the fence receiving member 104.

Although in the foregoing detailed description of embodiment 100 of the present invention the various elements of the invention have been characterized with some specificity, it will be understood that the various described elements may take alternative forms as suitable for the particular application of the present invention. For example, the workpiece guide 104 may be of any configuration suitable for its intended use, and the workpiece fence 106 may include any number of workpiece guide surfaces and channels as desirable. Moreover, other complementary arrangements for interposing a portion of the workpiece fence and one of the mounting members will be evident to one of ordinary skill in the art upon considering the present disclosure of the invention, and all such arrangements are intended to be encompassed by the present invention. In addition, although the workpiece guide 100 includes four linking members in the form of four studs 150 that are threadedly received in two link receiving members 162, it will be understood that, for example, any number of linking members may be used, with a suitable complement of link receiving members. In that way, movement of a single link receiving member may be coupled by a transmission or other linkage to one or more of the remaining link receiving members to simultaneously move each of the coupled link receiving members. Thus, as little as two linking members, one attached to each mounting member and both attached to a single link receiving member, may be used.

The workpiece guide 100 provides an improvement over existing workpiece guide designs and, in particular, relative to the arrangement of the '184 patent provides for a reduction in the number of steps and the time required to reposition the workpiece fence on the workpiece fence receiving member. Although not specifically disclosed in detail herein, each of the elements of the assembly of the present invention may be constructed of a material appropriate for its particular application. For example, the workpiece fence may be fabricated from aluminum extrusion, as is known in the art, or from other durable materials. The several remaining elements may be fabricated from, for example, aluminum, steel, a suitable aluminum- or iron-based alloy, or other durable materials. Applications differing from that of the foregoing embodiment may dictate or require the use of other materials.

Although the foregoing description of an embodiment of the invention has specific application as a rip fence to be mounted across the workpiece support surface of a table saw, an appropriately configured embodiment of the present invention may be employed in any environment wherein it is desirable to, for example, provide a workpiece guide having a selectively positionable guiding component for guiding a workpiece across a workpiece supporting surface of a cutting device or other device. Those of ordinary skill in the art will appreciate that various changes in the configurations, details, materials, and arrangement of the elements that have been herein described and illustrated in order to explain the nature of the invention may be made by those skilled in the art, and all such modifications will remain within the principle and scope of the invention as expressed herein in the appended claims.

We claim:

1. A workpiece guide comprising:

a fence including a workpiece guide surface and an attachment portion;

a fence receiving member including:

a body having a top surface interconnecting opposed first and second substantially vertical sides; and an attachment system to secure said fence adjacent to either one of said opposed first and second sides, said attachment system including:

a first mounting member disposed adjacent said first side; and a second mounting member disposed adjacent said second side;

wherein said attachment portion is selectively receivable by either one of said first mounting member and said second mounting member intermediate said body, said attachment system selectively simultaneously biasing said first mounting member toward said first side and said second mounting member toward said second side to thereby cause clamping engagement of said attachment portion between said body and said either one of said first mounting member and said second mounting member.

2. The workpiece guide of claim 1, wherein said attachment system comprises:

a plurality of linking members, a first linking member connected to said first mounting member, a second linking member connected to said second mounting member; and a link receiving member connected to said first linking member and said second linking member, said link receiving member selectively simultaneously biasing said first linking member toward said first side and said second linking member toward said second side.

3. The workpiece guide of claim 2 wherein movement of said link receiving member selectively simultaneously biases said first mounting member and said second mounting member toward said link receiving member.

4. The workpiece guide of claim 3 wherein rotation of said link receiving member selectively simultaneously biases said first mounting member and said second mounting member toward said link receiving member and toward said first side and said second side of said fence receiving member.

5. The workpiece guide of claim 4, wherein rotation of said link receiving member selectively secures said portion of said fence in said selected intermediate position.

6. A workpiece guide comprising:

a fence including a workpiece guide surface and an attachment portion;

a fence receiving member including:

a body having a top surface interconnecting opposed first and second substantially vertical sides;

an attachment system to secure said fence adjacent to either one of said opposed first and second sides; said attachment system including:

a first mounting member disposed adjacent said first side;

a second mounting member disposed adjacent said second side;

a first linking member connected to said first mounting member; and a second linking member connected to said second mounting member;

wherein said attachment portion is selectively receivable by either one of said first mounting member and said second mounting member intermediate said body and a first link receiving member connected to both said first linking member and said second linking member and selectively simultaneously biasing said first mounting member and said second mounting member toward said first link receiving member to thereby cause clamping engagement of said attachment portion between said body and said either one of said first mounting member and said second mounting member.

7. The workpiece guide of claim 6 wherein:

said first linking member and said second linking member each includes a threaded region; and said first link receiving member includes a threaded region threadedly receiving at least a portion of said threaded region of each of said first linking member and said second linking member.

8. The workpiece guide of claim 6, wherein the workpiece guide is a rip fence selectively attachable to a table saw.

9. A workpiece guide comprising:

a fence including a workpiece guide surface and an attachment portion;

a fence receiving member including a body with a top surface interconnecting opposed first and second substantially vertical sides;

an attachment system to secure said fence adjacent to either one of said opposed first and second sides, said attachment system including:

a first mounting member disposed adjacent said first side;

a second mounting member disposed adjacent said second side;

a first link connected to said first mounting member;

a second link connected to said second mounting member;

wherein said attachment portion is selectively receivable by either one of said first mounting member and said second mounting member intermediate said body and a first link receiving member connected to said first link and said second link, movement of said first link receiving member varying a distance between said first mounting member and said second mounting member to thereby cause clamping engagement of said attachment portion between said body and said either one of said first mounting member and said second mounting member.

10. The workpiece guide of claim 9, wherein rotation of said first link receiving member varies a distance between said first mounting member and said second mounting member.

11. The workpiece guide of claim 10, wherein:

each said first link and said second link includes a threaded region, said threaded region of said first link threaded in a direction opposite to said threaded region of said second link; and said link receiving member is threadedly attached to said first link and said second link.

12. A table saw rip fence comprising:

a fence receiving member having a first side and a second side;

a first plate disposed adjacent said first side;

a second plate disposed adjacent said second side;

a plurality of primary links, each said primary link connected to a first mounting member and having a threaded region threaded in a first direction;

a plurality of secondary links, each said secondary link connected to a second mounting member and having a threaded region threaded in a second direction and opposite said first direction;

at least two link receiving members, each said link receiving member threadedly connected to said threaded region of one of said primary links and said threaded region of one of said secondary link; and a linkage connecting each said link receiving member, rotation of said link receiving members transmitted through said linkage to rotate said link receiving members and to thereby vary a distance between said first mounting member and said second mounting member.

13. The table saw rip fence of claim 12, further comprising a fence including a workpiece guide surface and an attachment portion, said attachment portion positionable intermediate of either one of:

said first mounting member and said first side; and said second mounting member and said second side.

14. A workpiece guide comprising:

a fence including a workpiece guide surface and an attachment portion;

a fence receiving member including a body having a top surface interconnecting opposed first and second substantially vertical sides, said fence receiving member comprising a first mounting member disposed adjacent said first side, a second mounting member disposed adjacent said second side, wherein said attachment portion is selectively receivable by either one of said first mounting member and said second mounting member, a first linking member connected to said first mounting member, a second linking member connected to said second mounting member, and a first link receiving member connected to both said first linking member and said second linking member and selectively simultaneously biasing said first mounting member and said second mounting member toward said first link receiving member to cause clamping engagement of said attachment portion between said body and said either one of said first mounting member and said second mounting member.

15. A workpiece guide comprising:

a fence receiving member including first and second sides;

a first mounting member disposed adjacent said first side;

a second mounting member disposed adjacent said second side;

a first linking member connected to said first mounting member, said first linking member including a threaded region;

a second linking member connected to said second mounting member, said second linking member including a threaded region;

first link receiving member connected to both said first linking member and said second linking member and selectively simultaneously biasing said first mounting member and said second mounting member toward said first link receiving member, said first link receiving member including a threaded region threadedly receiving at least a portion of said threaded region of each of said first linking member and said second linking member.

16. A workpiece guide comprising a fence receiving member having a first side and a second side;

a first mounting member disposed adjacent said first side;

a second mounting member disposed adjacent said second side;

a first link connected to said first mounting member, said first link including a threaded region;

a second link connected to said second mounting member, said second link including a threaded region, said threaded region of said first link threaded in a direction opposite to said threaded region of said second link; and a first link receiving member threadedly connected to said first link and said second link, wherein rotation of said first link receiving member varies a distance between said first mounting member and said second mounting member.

17. A workpiece guide comprising:

a fence receiving member including a body having opposed first and second sides;

a first mounting member disposed adjacent said first side;

a second mounting member disposed adjacent said second side;

a fence including a workpiece guide surface, a portion of said fence selectively positionable intermediate said body and either one of said first mounting member and said second mounting member; and an attachment system connected to said body and connected to said first mounting member and said second mounting member, said attachment system selectively simultaneously biasing said first mounting member toward said first side and said second mounting member toward said second side to thereby selectively secure said fence to said fence receiving member, said attachment system comprising:

a first linking member and a second linking member each including a threaded region; and a first link receiving member threadedly receiving at least a portion of said threaded region of each of said first linking member and said second linking member.

18. The workpiece guide of claim 17, wherein rotation of said link receiving member simultaneously threadedly advances said first linking member and said second linking member into said first link receiving member.

19. The workpiece guide of claim 18, wherein said threaded region of one of said first linking member and said second linking member includes right hand threads and the threaded region of other of said first linking member and said second linking member includes left hand threads.

20. The workpiece guide of claim 19, further comprising:

a third linking member, said third linking member connected to said first mounting member and including a threaded region;

a fourth linking member, said forth linking member connected to said second mounting member and including a threaded region; and a second link receiving member including a threaded region and being threadedly connected to both said third linking member and said fourth linking member, rotation of said second link receiving member simultaneously threadedly advancing said third linking member and said fourth linking member into said second link receiving member.

21. The workpiece guide of claim 20, wherein said threaded region of one of said third linking member and said fourth linking member includes right hand threads and said threaded region of other of said third linking member and said fourth linking member includes left hand threads.

22. The workpiece guide of claim 21, wherein:

each said first mounting member and said second mounting member is a plate;

and each of said linking members is a stud having a first end including said threaded region and a second end connected to a said plate.

23. The workpiece guide of claim 21, further comprising:

a linkage connecting said first link receiving member and said second link receiving member.

24. The workpiece guide of claim 23, wherein rotation of said first link receiving member is transmitted through said linkage and rotates said second link receiving member.

25. The workpiece guide of claim 24, wherein rotation of one of said first link receiving member and said second link receiving member simultaneously biases said first mounting member and said second mounting member toward said fence receiving member and secures said portion of said fence in said selected intermediate position.

26. The workpiece guide of claim 25, further comprising:

a lever connected to one of said first link receiving member and said second link receiving member.

27. The workpiece guide of claim 26, wherein:

said first linking member is disposed through said first side; and said second linking member is disposed through said second side.

28. The workpiece guide of claim 27, wherein:

said fence receiving member de fines a cavity; and said first link receiving member and said second link receiving are disposed within said cavity.

29. The workpiece guide of claim 28, wherein said linkage comprises:

a first post, connected to said first link receiving member;

a second post, connected to said second link receiving member; and a connecting member rotatably connected to both said first post and said second post.

30. The workpiece guide of claim 29, wherein said connecting member comprises:

a first rod having a threaded region and rotatably connected to said first link receiving member;

a second rod having a threaded region and rotatably connected to said second link receiving member; and a nut having a threaded region threadedly connected to each said threaded region of said first rod and said second rod, rotation of said nut simultaneously biasing said first post and said second post toward said nut to vary a length of said connecting member.

31. A workpiece guide comprising a fence receiving member including a body with opposed first and second sides;

a first mounting member disposed adjacent said first side;

a second mounting member disposed adjacent said second side;

a first link comprising a first threaded region, said first link connected to said first mounting member;

a second link comprising a second threaded region, said second link connected to said second mounting member, said first threaded region of said first link threaded in a direction opposite to said second threaded region of said second link;

a fence including a workpiece guide surface, a portion of said fence selectively positionable intermediate of a workpiece receiving member and one of said first mounting member and said second mounting member; and a first link receiving member threadedly connected to said first link and said second link, movement of said first link receiving member varying a distance between said first mounting member and said second mounting member to thereby secure said fence to said workpiece receiving member.

32. The workpiece guide of claim 31, further comprising:

a third link connected to said first mounting member and including a threaded region;

a fourth link connected to said second mounting member and including a threaded region, said threaded region of said third link threaded in a direction opposite to said threaded region of said fourth link;

a second link receiving member threadedly attached to said third link and said fourth link; and a transmission connecting said first link receiving member and said second link receiving member.

33. The workpiece guide of claim 32, wherein rotation of said first link receiving member is conveyed through said transmission to rotate said second link receiving member.

34. A workpiece guide comprising:

a fence receiving member including first and second sides;

a first mounting member disposed adjacent said first side;

a second mounting member disposed adjacent said second side;

a first linking member connected to said first mounting member and including a threaded region;

a second linking member connected to said second mounting member and including a threaded region; and a first link receiving member including a threaded region threadedly receiving at least a portion of said threaded region of each of said first linking member and said second linking member and selectively simultaneously biasing said first mounting member and said second mounting member toward said first link receiving member.

35. The workpiece guide of claim 34, wherein rotation of said link receiving member simultaneously threadedly advances said first linking member and said second linking member into said first link receiving member.

36. The workpiece guide of claim 35, wherein said threaded region of one of said first linking member and said second linking member includes right hand threads and the threaded region of other of said first linking member and said second linking member includes left hand threads.

37. The workpiece guide of claim 36, further comprising:

a third linking member, said third linking member connected to said first mounting member and including a threaded region;

a fourth linking member, said forth linking member connected to said second mounting member and including a threaded region; and a second link receiving member including a threaded region and being threadedly connected to both said third linking member and said fourth linking member, rotation of said second link receiving member simultaneously threadedly advancing said third linking member and said fourth linking member into said second link receiving member.

38. The workpiece guide of claim 37, wherein said threaded region of one of said third linking member and said fourth linking member includes right hand threads and said threaded region of the other of said third linking member and said fourth linking member includes left hand threads.

39. The workpiece guide of claim 38, wherein:

each of said first mounting member and said second mounting member is a plate;

and each of said linking members is a stud having a first end including said threaded region and a second end connected to a said plate.

40. The workpiece guide of claim 38, further comprising:

a linkage connecting said first link receiving member and said second link receiving member.

41. The workpiece guide of claim 40, wherein rotation of said first link receiving member is transmitted through said linkage and rotates said second link receiving member.

42. The workpiece guide of claim 41, further comprising:

a fence including a workpiece guide surface and an attachment portion, said attachment portion selectively positionable intermediate of either:

said first mounting member and said first side; and said second mounting member and said second side.

43. The workpiece guide of claim 42, wherein rotation of one of said first link receiving member and said second link receiving member simultaneously biases said first mounting member and said second mounting member toward said fence receiving member and secures said attachment portion in a selected intermediate position.

44. The workpiece guide of claim 43, further comprising:

a lever connected to one of said first link receiving member and said second link receiving member.

45. The workpiece guide of claim 44, wherein:

said first linking member is disposed through said first side; and said second linking member is disposed through said second side.

46. The workpiece guide of claim 45, wherein:

said fence receiving member defines a cavity; and said first link receiving member and said second link receiving are disposed within said cavity.

47. The workpiece guide of claim 46, wherein said linkage comprises:

a first post, connected to said first link receiving member;

a second post, connected to said second link receiving member; and a connecting member rotatably connected to both said first post and said second post.

48. The workpiece guide of claim 47, wherein said connecting member comprises: a first rod having a threaded region and rotatably connected to said first link receiving member;

a second rod having a threaded region and rotatably connected to said second link receiving member; and a nut having a threaded region threadedly connected to each of said threaded region of said first rod and said second rod, rotation of said nut simultaneously biasing said first post and said second post toward said nut to vary a length of said connecting member.

49. The workpiece guide of claim 34, wherein the workpiece guide is a rip fence selectively attachable to a table saw.

50. A workpiece guide comprising a fence receiving member having a first side and a second side;

a first mounting member disposed adjacent said first side;

a second mounting member disposed adjacent said second side;

a first link connected to said first mounting member and including a threaded region;

a second link connected to said second mounting member and including a threaded region; and a first link receiving member threadedly connected to said first link and said second link such that rotation of said link receiving member varies a distance between said first mounting member and said second mounting member.

51. The workpiece guide of claim 50, further comprising:

a third link connected to said first mounting member and including a threaded region;

a fourth link connected to said second mounting member and including a threaded region, said threaded region of said third link threaded in a direction opposite to said threaded region of said fourth link;

a second link receiving member threadedly attached to said third link and said fourth link; and a transmission connecting said first link receiving member and said second link receiving member.

52. The workpiece guide of claim 51, wherein said rotation of said first link receiving member is conveyed through said transmission to rotate said second link receiving member.

53. The workpiece guide of claim 52, further comprising a fence including a workpiece guide surface and an attachment portion, said attachment portion selectively positionable between either one of:

said first mounting member and said first side; and said second mounting member and said second side.

54. A table saw, comprising:

a table having a length;

a cutting member;

a fence receiving member having opposed first and second sides and being movably coupled to said table for selective travel in a first lengthwise direction and a second lengthwise direction, said fence receiving member having a first mounting member movably disposed adjacent said first side and a second mounting member movably disposed adjacent said second side; and an attachment system mounted to said fence receiving member and connected to said first mounting member and said second mounting member, said attachment system selectively simultaneously biasing said first mounting member in said first lengthwise direction toward said first side and said second mounting member in said second lengthwise direction toward said second side.

* * * * *